US009689148B2

(12) United States Patent
Zou et al.

(10) Patent No.: US 9,689,148 B2
(45) Date of Patent: Jun. 27, 2017

(54) MIXER CONNECTION MECHANISM CONVENIENT TO BE MOUNTED ON COUNTERTOP

(71) Applicant: PRIMY CORPORATION LIMITED, Guangdong (CN)

(72) Inventors: Xuguang Zou, Guangdong (CN); Knud Robert Samsing, Guangdong (CN); Venkat Tirunagaru, Guangdong (CN); Zhuofei Chen, Guangdong (CN); Xiaobo Li, Guangdong (CN)

(73) Assignee: PRIMY CORPORATION LIMITED, Guangdong (CN)

( * ) Notice: Subject to any disclaimer, the term of this patent is extended or adjusted under 35 U.S.C. 154(b) by 52 days.

(21) Appl. No.: 14/790,904

(22) Filed: Jul. 2, 2015

(65) Prior Publication Data

US 2016/0258142 A1 Sep. 8, 2016

(30) Foreign Application Priority Data

Mar. 4, 2015 (CN) ..... 2015 1 0096668

(51) Int. Cl.
*E03C 1/042* (2006.01)
*E03C 1/04* (2006.01)

(52) U.S. Cl.
CPC ..... *E03C 1/0402* (2013.01)

(58) Field of Classification Search
CPC ..... E03C 1/0401
(Continued)

(56) References Cited

U.S. PATENT DOCUMENTS

2008/0256702 A1* 10/2008 Yeh ..... A47K 5/1205 4/675
2008/0301871 A1* 12/2008 Hanson ..... E03C 1/266 4/695

(Continued)

FOREIGN PATENT DOCUMENTS

CN 203247651 U 10/2013
CN 203905099 U 10/2014

(Continued)

OTHER PUBLICATIONS

State Intellectual Property Office, Chinese Office Action for Application No. 201510096668.5, mailed Nov. 25, 2015.

*Primary Examiner* — Lori Baker
(74) *Attorney, Agent, or Firm* — Honigman Miller Schwartz and Cohn LLP; Matthew H. Szalach

(57) ABSTRACT

A mixer connection mechanism convenient to be mounted on a countertop is provided, which may be provided to be mounted to a countertop of a sink having a mounting hole. The mixer connection mechanism includes a base seat, a locking device, a screw rod assembly, and a position-limiting blocking lever. The screw rod assembly and position-limiting blocking lever are arranged between the base seat and the locking device. When mounted, the screw rod assembly is screwed up by an operation above the countertop of the sink to allow the screw rod assembly to be rotated, whereby rotation of the locking device is limited by the position-limiting blocking lever. Further, the locking device moves towards the countertop of the sink and abuts against a lower surface of the countertop of the sink. Meanwhile, an abutting end at the bottom of the surrounding wall abuts against the countertop of the sink.

11 Claims, 8 Drawing Sheets

(58) Field of Classification Search
USPC ..... 4/695
See application file for complete search history.

(56) References Cited

U.S. PATENT DOCUMENTS

| | | | | |
|---|---|---|---|---|
| 2013/0048122 | A1* | 2/2013 | Hsu | E03C 1/0401 137/625.4 |
| 2016/0138252 | A1* | 5/2016 | Sansum | E03C 1/0401 4/695 |

FOREIGN PATENT DOCUMENTS

| | | | |
|---|---|---|---|
| CN | 204112420 | U | 1/2015 |
| WO | WO-2009069157 | A1 | 6/2009 |

* cited by examiner

MIXER CONNECTION MECHANISM CONVENIENT TO BE MOUNTED ON COUNTERTOP

CROSS REFERENCE TO RELATED APPLICATIONS

The present application claims priority to Chinese Patent Application No. 201510096668.5, titled "Mixer Connection Mechanism Convenient to be Mounted on Countertop" filed with the Chinese State Intellectual Property Office on Mar. 4, 2015, the entire disclosure of which is incorporated herein by reference.

TECHNICAL FIELD

The present application relates to the technical filed of kitchen apparatus, particularly to a mixer connection mechanism convenient to be mounted on a countertop.

BACKGROUND

This section provides background information related to the present disclosure which is not necessarily prior art.

When a mixer is mounted on a countertop, a mounting hole for the mixer is generally located more inside than a sink since the countertop and the sink are secured previously. The mixer, when being mounted, is required to be inserted into the mounting hole from the top to the bottom, and then, the mixer is required to be fixed by a locking nut from the bottom of the countertop. When being mounted, the mixer is required to be held in place by one hand of an installer, and the locking nut is required to be tightened by the other hand of the installer from the bottom of the countertop. Thus, it is quite difficult for only one installer to complete the mounting process due to a small mounting space, limited arm stretch and limited viewing angle. Furthermore, the mixer is required to be mounted not only accurately but also securely. Thus, two installers are sometimes required to cooperate to complete the mounting process. That is, one installer lies down under the countertop to screw up the locking nut, and the other installer holds the mixer in place, which is labor and time consuming.

SUMMARY

For overcoming the defects in the above described conventional technology, a mixer connection mechanism convenient to be mounted on a countertop is provided by the present application, which may simplify the whole mounting process and improve the mounting efficiency.

A mixer connection mechanism convenient to be mounted on a countertop is provided according to the present application, which may be provided for being mounted on a countertop of a sink, which has a mounting hole, and the mixer connection mechanism includes a base seat, a locking device, and a screw rod assembly and a position-limiting blocking lever which are arranged between the base seat and the locking device, wherein a surrounding wall is provided around the base seat, and an abutting end is provided at the bottom portion of the surrounding wall for abutting an upper surface of the countertop of the sink;

a fixing boss and an mounting passage for a cold water tube and a hot water tube are provided inside the surrounding wall, and the fixing boss is provided with a threaded through hole;

the locking device includes a rotating shaft and two locking blocks arranged in parallel with each other, and the rotating shaft is provided with a threaded hole, an upper end of the screw rod assembly passes through the threaded through hole and a lower end is in cooperation with the threaded hole of the rotating shaft, the two locking blocks are rotatably cooperated with the rotating shaft, and when the locking block is in a free state, the locking block is in a horizontal state; and one end of the position-limiting blocking lever is secured to the base seat, and when the screw rod assembly is rotated, the other end of the positioning-limiting blocking lever becomes to abut against the locking blocks for limiting the circumferential rotation of the locking device, and the rotating shaft allows the locking block to move towards the countertop of the sink until the locking block abuts against a lower surface of the countertop of the sink.

Alternatively, a hollow portion is provided between two locking blocks, and the rotating shaft is arranged in the hollow portion, and the two locking blocks are respectively provided with a rotating shaft hole for placing and securing the rotating shaft; and the position-limiting blocking lever passes through the hollow portion.

Alternatively, the two locking blocks are respectively provided with multiple engaging teeth, and the engaging teeth are configured to abut against and engage with the lower surface of the countertop of the sink.

Alternatively, the abutting end is provided with an annular groove, and an O-ring seal is provided in the annular groove, and the O-ring seal protrudes out of the annular groove.

Alternatively, an end portion of the screw rod assembly is provided with a countersunk head nut.

Alternatively, an outer portion of the surrounding wall is provided with an annular engaging stage for being connected and engaged with the mixer.

Alternatively, the mixer connection mechanism convenient to be mounted on the countertop further includes a drawable tube sheath; and the fixing boss is provided with a drawable tube hole, and the drawable tube sheath is mounted in the drawable tube hole for placing the drawable tube.

Alternatively, the threaded through hole extends out of the fixing boss, and extends to an end of the surrounding wall; and an extension portion of the threaded through hole extending out of the fixing boss abuts against an inner wall of the surrounding wall.

Alternatively, the fixing boss is provided with an insertion hole for the position-limiting blocking lever for inserting the position-limiting blocking lever; and the insertion hole for the position-limiting blocking lever is provided with an extension portion of the insertion hole for the position-limiting blocking lever extending out of the fixing boss; the extension portion of the insertion hole for the position-limiting blocking lever extends to the end of the surrounding wall and abuts an inner wall of the surrounding wall.

Alternatively, the rotating shaft hole is arranged in a middle position on each of the two locking blocks;

the two locking block form a U-shaped cross section.

As illustrated in the above technical solutions, the present application has the following advantages.

When the mixer is mounted, the screw rod assembly is screwed up by an operation above the sink countertop to allow the screw rod assembly to be rotated, and the rotation of the locking device is limited by the position-limiting blocking lever, then, the locking device moves towards the countertop of the sink and abuts against the lower surface of the countertop of the sink. Meanwhile, the abutting end at the bottom of the surrounding wall abuts against the upper surface of the countertop of the sink. In this way, the abutting end at the bottom of the surrounding wall and the locking device respectively clamp the upper surface and the lower surface of the countertop of the sink tightly, thus, the mixer connection mechanism is secured. Then, the mixer can be connected to the connecting mechanism. Such a mounting process is convenient, and also addresses the issue of a mounting process impossible for only one installer due to a small mounting space, limited arm stretch and limited viewing angle as well as the requirement of the mixer being mounted not only accurately but also securely.

BRIEF DESCRIPTION OF THE DRAWINGS

The drawings described herein are for illustrative purposes only of selected configurations and are not intended to limit the scope of the present disclosure.

For more clearly illustrating technical solutions of the present application, drawings referred to describe will be briefly described hereinafter. Apparently, the drawings in the following description are only a few of embodiments of the present application, and for the person skilled in the art, other drawings may be obtained based on these drawings without any creative efforts.

Figure 1:
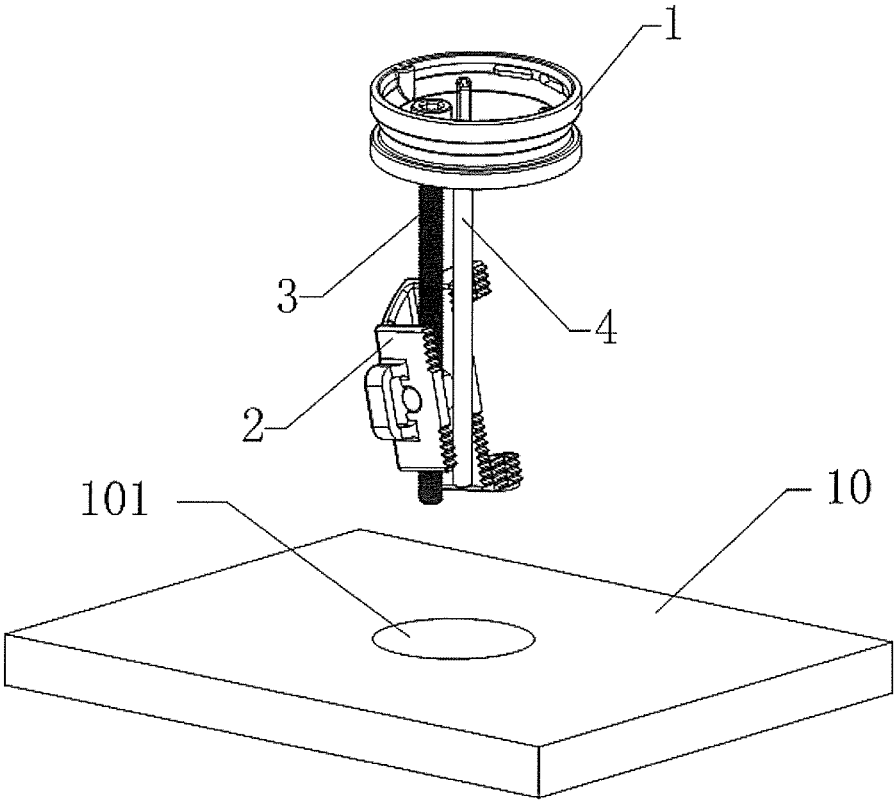
FIG. 1 is an overall structural view of a mixer connection mechanism according to an embodiment.

| Reference numerals in the Figures: | |
|---|---|
| 10. countertop of sink, | 101. mounting hole; |
| 1. base seat, | 11. surrounding wall, |
| 111. abutting end, | 112. annular engaging stage, |
| 12. fixing boss, | 121. threaded through hole, |
| 122. insertion hole for position-limiting blocking lever, | |
| 13. mounting passage, | 51. drawable tube hole, |
| 2. locking device, | 21. locking block, |
| 211. rotating shaft hole, | 212. engaging teeth, |
| 22. rotating shaft; | 221. threaded hole; |
| 3. screw rod assembly; | 31. countersunk head nut; |

-continued

| Reference numerals in the Figures: | |
|---|---|
| 4. position-limiting blocking lever; | 5. drawable tube sheath, |
| 8. mixer, | 81. hot and cold water tubes, |
| 82. drawable tube, | 14. O-ring seal. |

DETAILED DESCRIPTION OF THE EMBODIMENTS

For objects, features and advantages of the present application to be readily understood, the technical solutions protected by the present application will be described clearly and completely by using specific embodiments and drawings hereinafter. Apparently, the described embodiments are only a part of the embodiments of the present application, rather than all embodiments. Based on the embodiments in the present application, all of other embodiments, made by the person skilled in the art without any creative efforts, fall into the scope of the present application.

It should be appreciated that when an element or a layer is "on" another element or layer, or "connected" or "coupled" to another element or layer, the element or layer may be directly on the other element or layer, or connected or coupled directly to the other element or layer, and, a middle element or layer may be present. In contrast, when an element is "directly on" another element or layer, or "directly connected" or "directly coupled" to another element or layer, no middle elements or layers is present. Similar reference numerals through out all the drawings indicate similar elements. As is used here, terms "and/or" includes any one or all combinations of one or more of the related items listed Spatially relative terms, such as "under", "below", "lower portion", "on", "above" and the like, may be used herein, for ease of description, to describe the relationship of one element or feature and another element(s) or feature(s) as illustrated in the drawings. It should be appreciated that the spatially relative terms are intended to encompass orientations of the device in use or operation different with the orientation depicted in the drawings. For example, if the device in the drawings is turned over, the elements described as "under" or "below" other elements or features would then be oriented "on" the other elements or features. Thus, the exemplary term "under" can encompass on and under orientations. The device may be described in other orientation (rotated by 90 degrees or at other orientations) and the spatially relative terms used herein are interpreted correspondingly.

Figure 3:
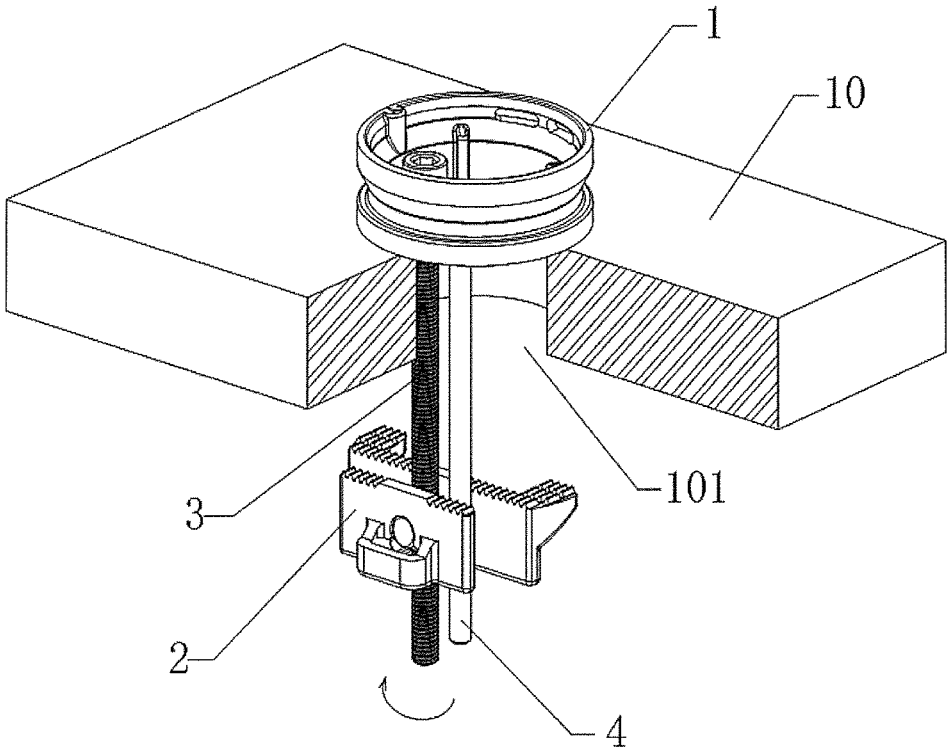
FIG. 3 is a structural view of the locking device in a horizontal state after passing through the mounting hole according to the embodiment.

A mixer connection mechanism convenient to be mounted on a countertop is provided according to an embodiment of the present application. Referring to FIG. 1, the mixer connection mechanism maybe provided to be mounted on a countertop 10 of a sink, which has a mounting hole 101. The mixer connection mechanism includes a base seat 1, a locking device 2, and a screw rod assembly 3 and a position-limiting blocking lever 4 which are arranged between the base seat 1 and the locking device 2. The locking device is rotatably cooperated with the screw rod assembly. The locking device 2 is capable of being rotated by 180 degrees with respect to a horizontal plane. In a case that the locking device 2 is in a vertical state, as shown in FIG. 1, the length of the locking device 2 is less than the diameter of the mounting hole 101, or, the sectional area of the locking device 2 is smaller than the sectional area of the mounting hole 101. The locking device 2 can pass through the mounting hole 101 to be placed on a lower portion of the countertop 10 of the sink. While in a case that the locking device 2 is in a horizontal state, as shown in FIG. 3, the length of the locking device is larger than the diameter of the mounting hole 101, or, the sectional area of the locking device 2 is larger than the sectional area of the mounting hole 101, and the locking device 2 abuts against a lower surface of the countertop 10 of the sink, and the diameter of the base seat 1 is larger than the diameter of the mounting hole 101. Thus, after the locking device 2 passes through the mounting hole 101, the base seat 1 abuts against on an upper surface of the mounting hole 101 of the countertop of the sink, and the locking device 2 abuts against the lower surface of the countertop 10 of the sink, such that the mixer connection mechanism is secured on the countertop 10 of the sink.

Figure 2:
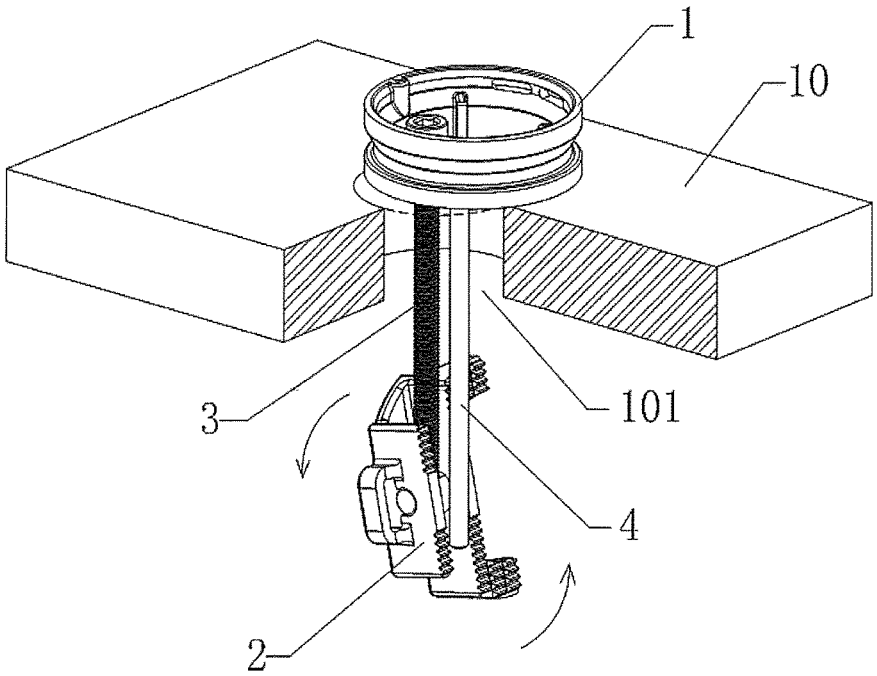
FIG. 2 is a structural view of a locking device in a vertical state after passing through a mounting hole according to the embodiment.
Figure 4:
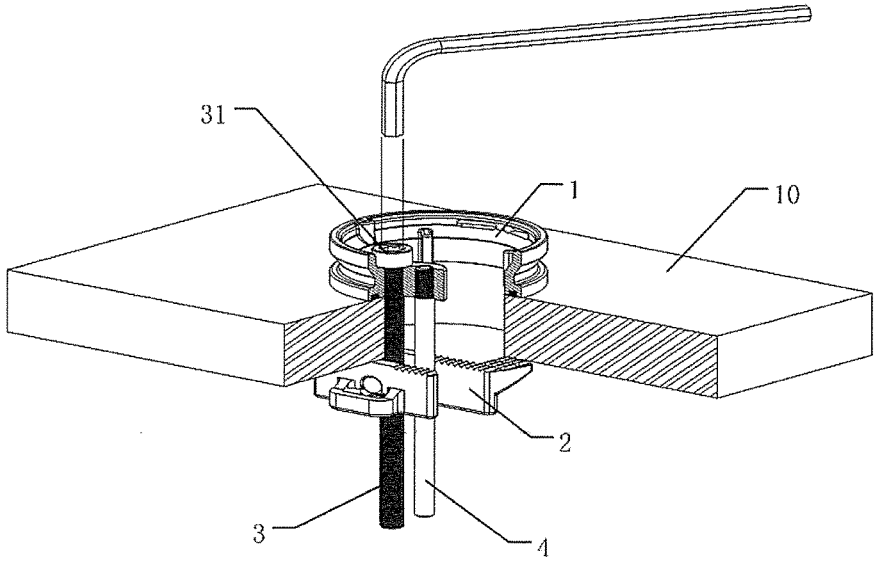
FIG. 4 is a schematic view of a screw rod assembly being rotated according to the embodiment.

In FIG. 1, the locking device 2 is shown in a vertical state, in which the locking device has yet to pass through the mounting hole 101. In FIG. 2, the locking device 2 is shown in another vertical state, in which the locking device has been passed though the mounting hole 101. In FIG. 3, the locking deice 2 is shown in a horizontal state, in which the locking device is overturned after passing though the mounting hole 101 due to gravity and rotating cooperation between the locking device and the screw rod assembly. In FIG. 4, the screw rod assembly 3 is rotated to allow the position-limiting blocking lever to abut against the locking device 2, in this way, the rotation of the locking device 2 is limited by the position-limiting blocking lever during the rotation of the screw rod assembly 3, thus, the locking device is moved towards the countertop 10 of the sink and abuts against the lower surface of the countertop 10 of the sink.

In the embodiment, an end portion of the screw rod assembly 3 is provided with a countersunk head nut 31. An installer may use an inside-hexagonal spanner to rotate the screw rod assembly 3, thus, the screw rod assembly 3 can be rotated and the locking device 2 becomes to abut against the lower surface of the countertop 10 of the sink.

Figure 5:
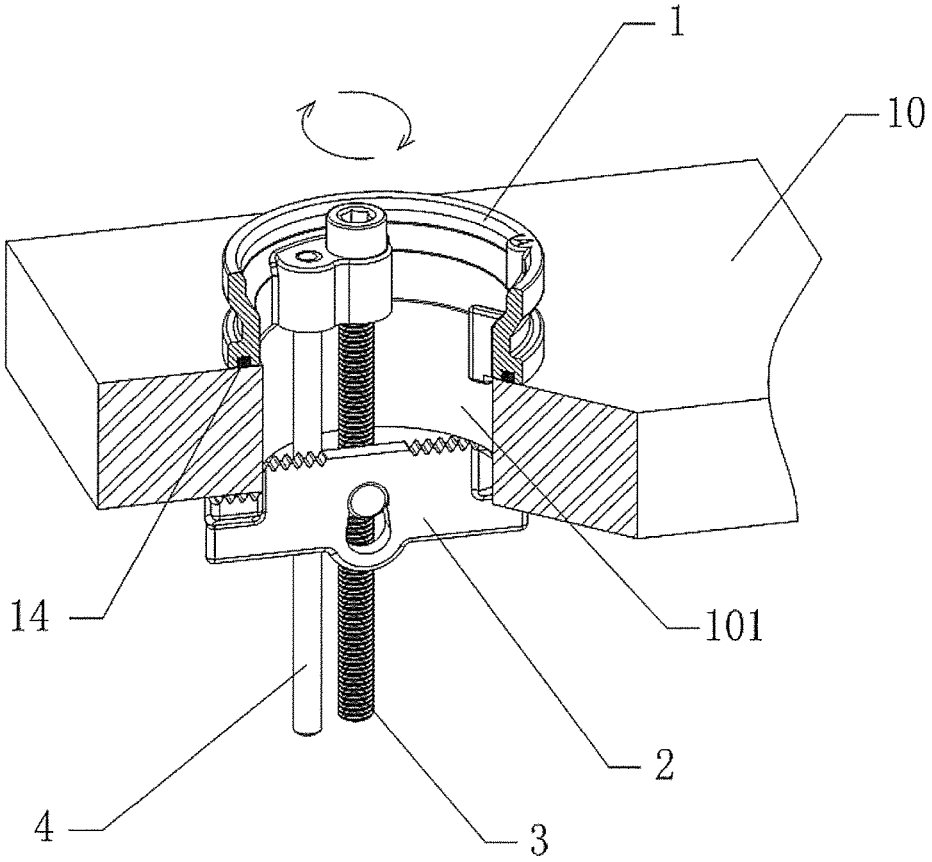
FIG. 5 is a schematic view showing that a base seat abuts against an upper surface of a countertop of a sink and a locking device abuts against a lower surface of the countertop of the sink.
Figure 6:
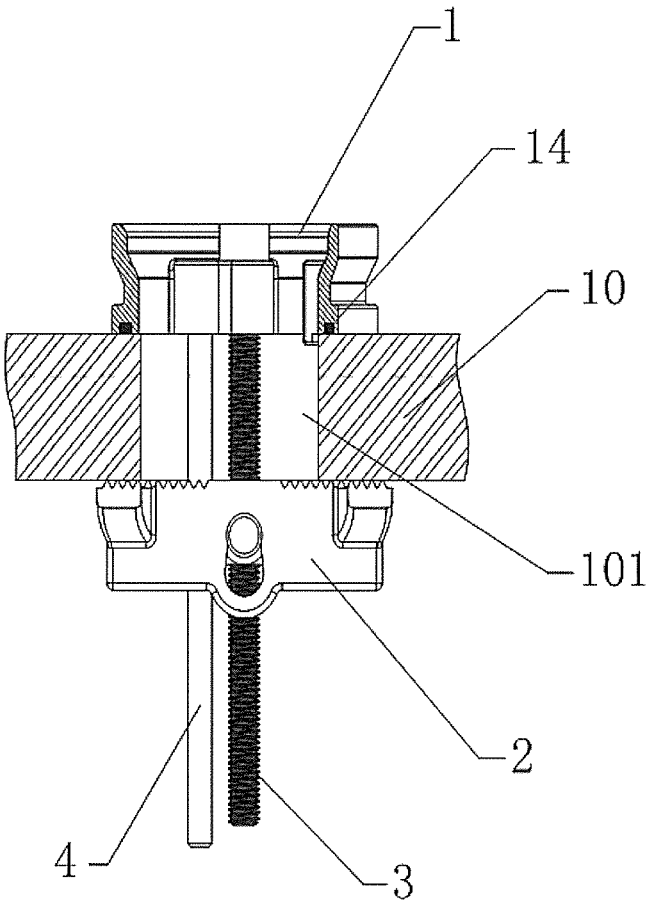
FIG. 6 is a sectional view of a whole structure in FIG. 5.

In FIG. 5, the base seat 1 abuts against the upper surface of the mounting hole 101 of the countertop of the sink, and the locking device 2 abuts against the lower surface of the countertop 10 of the sink. FIG. 6 is a sectional view of a whole structure in FIG. 5.

Figure 7:
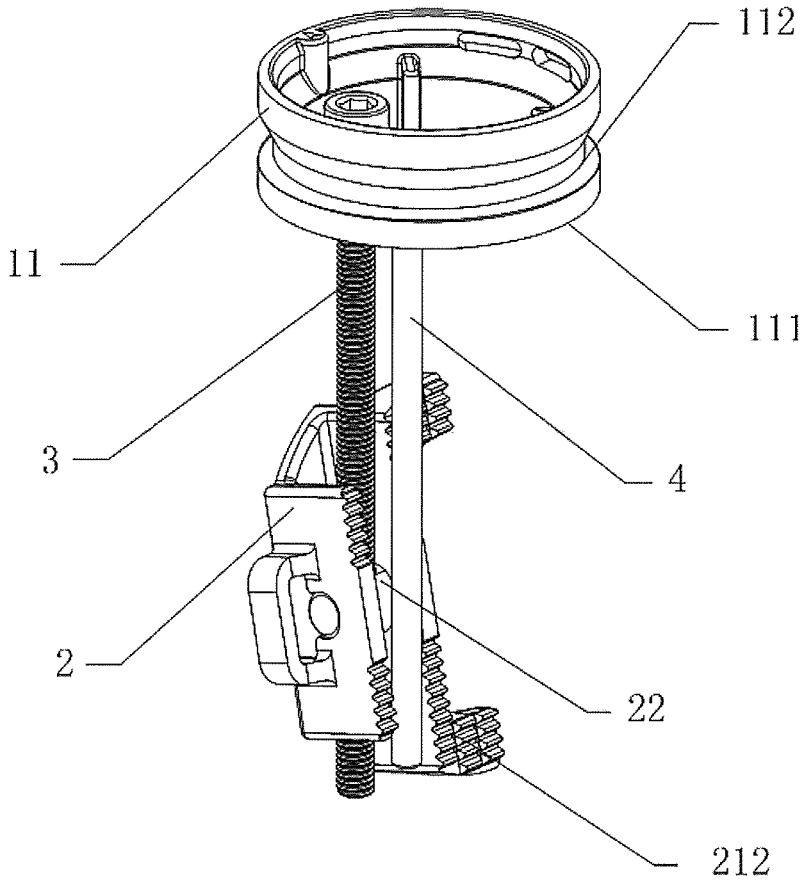
FIG. 7 is a structural view of a mixer connection mechanism according to the embodiment.
Figure 8:
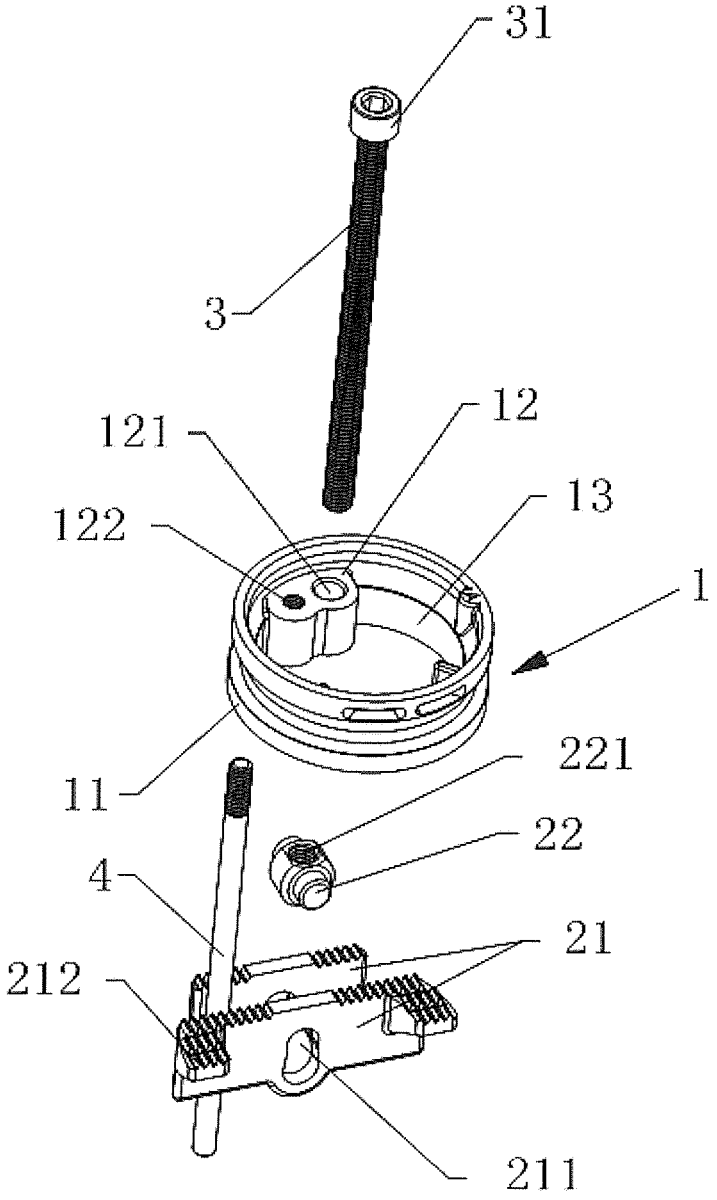
FIG. 8 is an exploded view of the mixer connection mechanism according to the embodiment.
Figure 9:
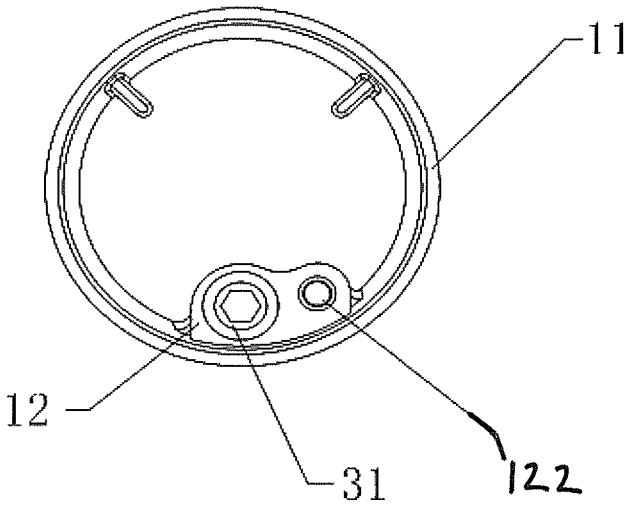
FIG. 9 is a top view of the mixer connection mechanism according to the embodiment.

In the embodiment, for the specific structure of the base seat 1, reference is made to FIG. 7 in conjunction with FIGS. 8, 9, 11 and 12. A surrounding wall 11 is provided around the base seat 1, and a bottom portion of the surrounding wall 11 is provided with an abutting end 111 for abutting against the upper surface of the countertop 10 of the sink.

A fixing boss 12 and a mounting passage 13 for a cold water tube and a hot water tube passing through are provided inside the surrounding wall 11. The fixing boss 12 is provided with a threaded through hole 121. The locking device 2 includes a rotating shaft 22 and two locking blocks 21 arranged in parallel with each other. The rotating shaft 22 is provided with a threaded hole 221. An upper end of the screw rod assembly 3 may pass through the threaded through hole 121 and a lower end of the screw rod assembly is cooperated with the threaded hole 221 of the rotating shaft 22. The two locking blocks 21 are rotatably cooperated with the rotating shaft 22, and when the two locking blocks 21 are in a free state, the two locking blocks 21 are in a horizontal state. One end of the position-limiting blocking lever 4 is secured to the base seat 1, and the other end of the positioning-limiting blocking lever 4 abuts against the two locking blocks 21, thus, the circumferential rotation of the locking device 2 is limited while the screw rod assembly 3 is rotated. The rotating shaft 22 allows the two locking blocks 21 to move towards the countertop of the sink until the two locking blocks 21 abut against the lower surface of the countertop of the sink.

In the embodiment, the threaded through hole 121 extends out of the fixing boss 12, and extends to an end of the surrounding wall 11. An extension portion of the threaded through hole 121 extending out of the fixing boss 12 abuts against an inner wall of the surrounding wall 11. The fixing boss 12 is provided with an insertion hole for a position-limiting blocking lever 122 for inserting the position-limiting blocking lever 4. The insertion hole for the position-limiting blocking lever 122 is provided with an extension portion of the insertion hole for the position-limiting blocking lever extending out of the fixing boss 12. The extension portion of the insertion hole for the position-limiting blocking lever 122 extends to the end of the surrounding wall 11 and abuts against the inner wall of the surrounding wall 11.

Both of the threaded through hole 121 and the insertion hole 122 for the position-limiting blocking lever extend to the end of the surrounding wall 11, thus, both of the threaded through hole 121 and the insertion hole 122 for the position-limiting blocking lever have a relatively long length, which ensures the stability of the screw rod assembly 3 after passing through the threaded through hole 121 and the stability of the position-limiting blocking lever 4 after passing through the insertion hole 122 for the position-limiting blocking lever. Thus, the screw rod assembly 3 will not be inclined when being rotated by an operator. Further, the long length of the threaded through hole 121 and the insertion hole 122 for the position-limiting blocking lever also reinforces the surrounding wall 11.

In the embodiment, a hollow portion is provided between two locking blocks 21, and the rotating shaft 22 is arranged in the hollow portion. The two locking blocks 21 are respectively provided with a rotating shaft hole 211 for mounting the rotating shaft. The position-limiting blocking lever 4 passes through the hollow portion to limit the rotation of the locking device 2, even if the screw rod assembly 3 is rotated.

Alternatively, the rotating shaft hole 211 is arranged in a middle position on each of the two locking blocks 21 to allow the two locking blocks to be arranged at two sides of the rotating shaft 22 in equilibrium with each other. The locking device 2 in the horizontal state is in parallel with the countertop 10 of the sink, the locking device 2 can abut against the countertop 10 of the sink tightly, improving a clamping force of the mixer connection mechanism.

The two locking blocks 21 form a U-shaped cross section, which can enlarge the abutting surface of the locking device 2 and the countertop 10 of the sink, and further improve the clamping force of the mixer connection mechanism, allowing the mixer to be secured more firmly on the countertop 10 of the sink.

In the embodiment, the screw rod assembly 3 passes through the rotating shaft hole 211 for securing the rotating shaft, and the position-limiting blocking lever 4 passes through the hollow portion between the two locking blocks 21. The screw rod assembly 3 and the position-limiting blocking lever 4 are arranged in parallel with each other. When the screw rod assembly 3 is rotated, the locking device 2 cannot be rotated along with the screw rod assembly 3 due to a limitation by the position-limiting blocking lever 4. Then, the locking device 2 moves towards the lower surface of the countertop 10 of the sink under the rotation of the screw rod assembly 3. The rotating shaft 22 is arranged between the two locking blocks 21, which may not only play a connecting role, but also allow the screw rod assembly 3 and the locking device 2 to be in a rotating cooperation. For further securing the two locking blocks in parallel with each other, bottom portions of the two locking blocks 21 are connected with each other.

In the embodiment, the two locking block 21 are respectively provided with multiple engaging teeth 212, and the engaging teeth are configured to engage with the lower surface of the countertop 10 of the sink, thereby further tightening the abutting of the locking blocks 21 and the lower surface of the countertop 10 of the sink.

In the embodiment, for preventing the water from leaking from the countertop 10 of the sink to the cabinet below the countertop, the abutting end 111 is provided with an annular groove, and an O-ring seal 14 is provided in the annular groove. The O-ring seal protrudes out of the annular groove. The O-ring seal 14 may be made of a rubber material or a silicon gel material. In a case that the base seat 1 abuts an upper surface of the countertop of the sink, the O-ring seal 14 is squeezed and deformed, thus the O-ring seal 14 plays a sealing role.

In the embodiment, an outer portion of the surrounding wall 11 is provided with an annular engaging stage 112 for being connected with the mixer in an engaging manner.

Figure 10:
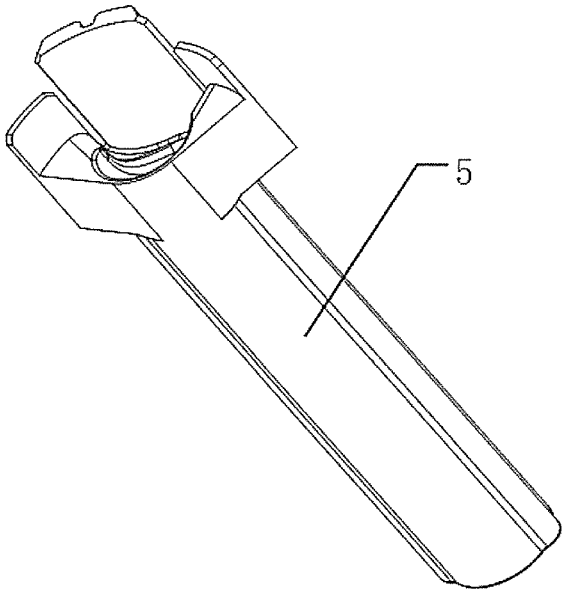
FIG. 10 is a structural view of an example drawable tube sheath.
Figure 11:
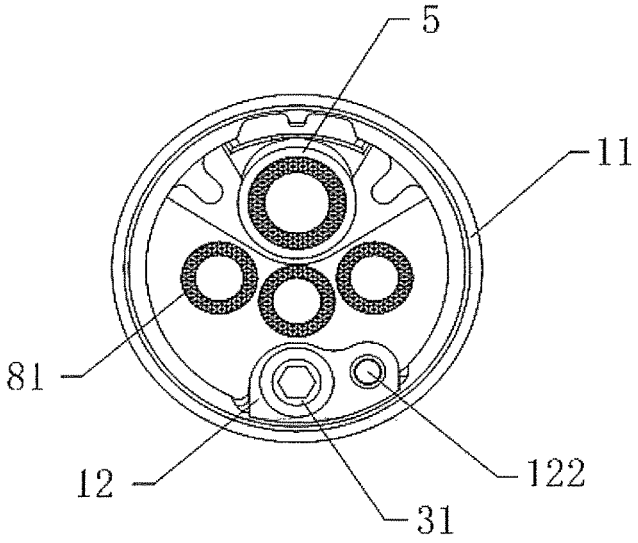
FIG. 11 is a top view of the mixer connection mechanism mounted with a hot water tube and a cold water tube.
Figure 12:
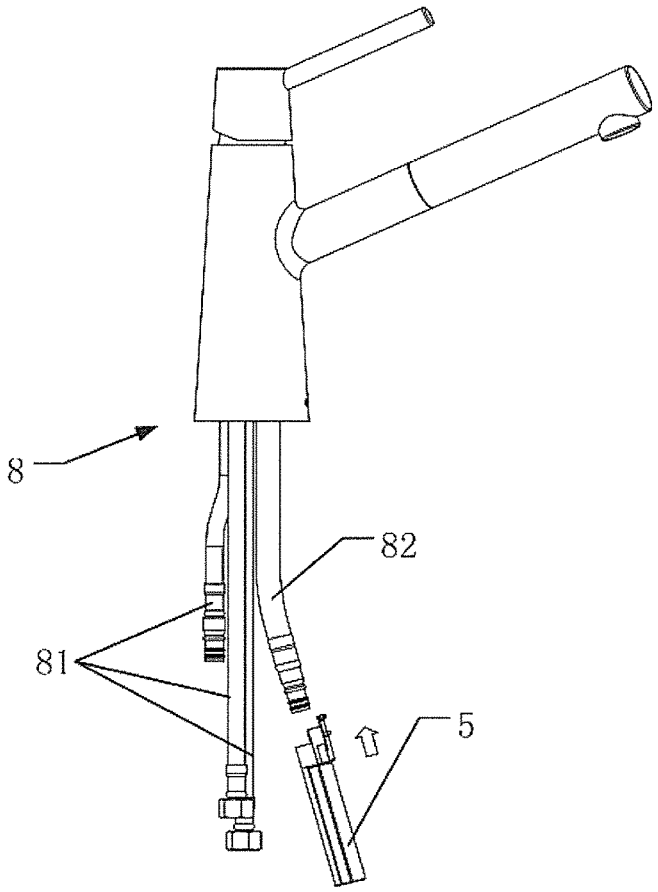
FIG. 12 is a structural view of an example mixer.

In the embodiment, reference is made to FIGS. 10, 11, and 12. A drawable tube sheath 5 is further provided. The fixing boss 12 is provided with a drawable tube hole 51, and the drawable tube sheath 5 is positioned in the drawable tube hole 51 for placing the drawable tube 82. The drawable tube sheath 5 facilitates placing the drawable tube 82 into the base seat 1, and prevents a shower head of the drawable tube 82 from being damaged due to friction.

FIG. 12 shows a mixer 8, which may be assembled with the mixer connection mechanism in the present application. Hot and cold water tubes 81 may pass through the mounting passage 13, and the mixer may be secured to the annular engaging stage in an engaging manner. When the mixer connection mechanism is mounted, the screw rod assembly 3 is screwed up by an operation above the countertop 10 of the sink, thus, the screw rod assembly 3 is rotated. The rotation of the locking device 2 is limited by the position-limiting blocking lever 4, and the locking device 2 moves towards the countertop 10 of the sink, and becomes to abut against the lower surface of the countertop 10 of the sink. Meanwhile, the abutting against end 111 at the bottom of the surrounding wall 11 abuts against the countertop 10 of the sink. In this way, the abutting end 111 at the bottom of the surrounding wall 11 and the locking device 2 respectively clamp on the upper surface and the lower surface of the countertop 10 of the sink, thus, the mixer connection mechanism is secured. Then, the mixer is connected with the connecting mechanism. Such a mounting process is convenient, and also addresses the issue of an mounting process impossible for only one installer due to a small mounting space, limited arm stretch and limited viewing angle as well as the requirement of the mixer being mounted not only accurately but also securely.

The above embodiments are described in a progressive manner. Each of the embodiments is mainly focused on describing its differences from other embodiments, and references may be made among these embodiments with respect to the same or similar portions among these embodiments.

For the above description of the disclosed embodiments, the person skilled in the art is capable of carrying out or using the present application. It is obvious for the person skilled in the art to make many modifications to these embodiments. The general principle defined herein may be applied to other embodiments without departing from the spirit or scope of the present application. Therefore, the present application is not limited to the embodiments illustrated herein, but should be defined by the broadest scope consistent with the principle and novel features disclosed herein.

What is claimed is:

1. A mixer connection mechanism mountable on a countertop of a sink having a mounting hole, the mixer connection mechanism comprising:

a base seat, a locking device, and a screw rod assembly and a position-limiting blocking lever which are arranged between the base seat and the locking device, wherein a surrounding wall is provided around the base seat, and a bottom portion of the surrounding wall is provided with an abutting end for abutting against an upper surface of the countertop of the sink;

a fixing boss and a mounting passage for a cold water tube and a hot water tube passing through are provided inside the surrounding wall, and the fixing boss is provided with a threaded through hole;

the locking device comprises a rotating shaft and two locking blocks arranged in parallel with each other, and the rotating shaft is provided with a threaded hole, and an upper end of the screw rod assembly passes through the threaded through hole and a lower end of the screw rod assembly is fitted with the threaded hole of the rotating shaft, the locking block is rotatably fitted with the rotating shaft, and when the locking block is in a free state, the locking block is in a horizontal state; and one end of the position-limiting blocking lever is secured to the base seat, and when the screw rod assembly is rotated, the other end of the positioning-limiting blocking lever abuts against the locking block to limit a circumferential rotation of the locking device, the rotating shaft allows the locking block to move towards the countertop of the sink until the locking block abuts against a lower surface of the countertop the sink.

2. The mixer connection mechanism according to claim 1, wherein:

the rotating shaft is arranged in a hollow portion between two locking blocks, each of the two locking blocks having a corresponding rotating shaft hole for securing the rotating shaft; and the position-limiting blocking lever passes through the hollow portion.

3. The mixer connection mechanism according to claim 2, wherein:

the two locking blocks include a plurality of engaging teeth, and the engaging teeth are configured to engage the lower surface of the countertop of the sink.

4. The mixer connection mechanism according to claim 2, wherein:

the rotating shaft hole is arranged in a middle position on each of the two locking block; and the two locking blocks form a U-shaped cross section.

5. The mixer connection mechanism according to claim 1, wherein:

the two locking blocks include a plurality of engaging teeth, and the engaging teeth are configured to engage the lower surface of the countertop of the sink.

6. The mixer connection mechanism according to claim 1, wherein:

the abutting end includes an annular groove, and an O-ring seal is disposed in the annular groove, the O-ring seal protruding out of the annular groove.

7. The mixer connection mechanism according to claim 1, wherein an end portion of the screw rod assembly includes a countersunk head nut.

8. The mixer connection mechanism according to claim 1, wherein an outer portion of the surrounding wall includes an annular engaging stage configured to connect with a mixer.

9. The mixer connection mechanism according to claim 1, further comprising a drawable tube sheath, wherein the fixing boss includes a drawable tube hole, and the drawable tube sheath is positioned in the drawable tube hole for placing a drawable tube.

10. The mixer connection mechanism according to claim 1, wherein:

the threaded through hole extends out of the fixing boss, and extends to an end of the surrounding wall; and an extension portion of the threaded through hole extending out of the fixing boss abuts against an inner wall of the surrounding wall.

11. The mixer connection mechanism according to claim 1, wherein:

the fixing boss includes an insertion hole for the position-limiting blocking lever for inserting the position-limiting blocking lever; and the insertion hole includes an extension portion for the position-limiting blocking lever extending out of the fixing boss, the extension portion of the insertion hole extends to the end of the surrounding wall and abuts against an inner wall of the surrounding wall.

* * * * *